United States Patent [19]

Bäcker et al.

[11] 4,042,321

[45] Aug. 16, 1977

[54] TANNING OF HIDES

[75] Inventors: Klaus Bäcker, Leverkusen; Helga Heinze, Cologne; Wolfhard Luck, Leverkusen; Heinrich Spahrkäs, Bergisch-Neukirchen, all of Germany

[73] Assignee: Bayer Aktiengesellschaft, Leverkusen, Germany

[21] Appl. No.: 573,282

[22] Filed: Apr. 29, 1975

[30] Foreign Application Priority Data

May 18, 1974 Germany ..... 2424301
May 18, 1974 Germany ..... 2424300

[51] Int. Cl.[2] ..... C14C 3/06
[52] U.S. Cl. ..... 8/94.26; 8/94.27
[58] Field of Search ..... 8/94.22, 94.26, 94.27; 260/45.75 G

[56] References Cited

U.S. PATENT DOCUMENTS

| | | | |
|---|---|---|---|
| 2,091,683 | 8/1937 | Immendoerfer | 8/94.26 |
| 2,178,874 | 11/1939 | Hervey | 8/94.26 |
| 2,580,417 | 1/1952 | Follett | 8/94.26 |
| 3,010,780 | 11/1961 | Plapper | 8/94.26 |
| 3,346,323 | 10/1967 | Spahrakäs | 8/94.27 |

OTHER PUBLICATIONS

Zissel, Das Leder, Jan. 23, 1972, pp. 174–183.

*Primary Examiner*—Paul R. Michl
*Attorney, Agent, or Firm*—Burgess, Dinklage & Sprung

[57] ABSTRACT

In the chrome-tanning of hides to produce leather wherein a hide is pickled, pretanned with a chromium (III) salt, and full tanned with a tanning mixture containing a chromium (III) salt, an acid-binding agent and a polycarboxylic acid or salt thereof, the improvement which comprises employing as said polycarboxylic acid or salt thereof at least 1.6 moles per mole of $Cr_2O_3$ in the chromium (III) salt employed for full tanning of an aliphatic dicarboxylic acid of 4 to 6 carbon atoms or an aromatic dicarboxylic or tricarboxylic acid containing 8 to 13 carbon atoms or a salt thereof, the total quantity of $Cr_2O_3$ employed in pretanning and full tanning ranging from 1.2 to 2% by weight of the hide, full tanning being carried out with up to 100% of the tanning liquor based on the weight of the hide to a final pH of the liquor of at least 3.6. Advantageously, a powder composition comprising additional chromium (III) salt, polycarboxylic acid or salt and acid-binding agent, preferably dolomite, is added after pretanning.

11 Claims, No Drawings

TANNING OF HIDES

In leather production, animal hides and skins are extensively tanned with chrome-based tanning agents. The residual liquors left after tanning have a relatively high chromium oxide content, for example from 6 to 10 g of $Cr_2O_3$ per liter. Altogether some 20 to 30% of the chromium oxide available is left behind unused in the residual liquors. Apart from the economic disadvantage, this incomplete utilization presents the leather manufacturer with difficulties when it comes to treating the effluents.

Accordingly, there has been no shortage of attempts to improve utilization of the residual liquors. For example, it has been proposed to continue reusing the liquor left behind after tanning following the addition to it after each tanning cycle of chrome tanning powder. This process is complicated, and leather fibers and salts accumulate to an increasing extent in the repeatedly reused liquors.

Increasing the pH-values of the tanning liquors increases the affinity of the chrome tanning agents for the skin. Accordingly, it is readily possible to obtain complete utilization of the chrome tanning agents by suitably increasing the pH-values of the liquors. Unfortunately, the increased astringence of the chrome tanning agents results in the formation of so-called "drain-grain" leathers, i.e., leathers which are not smooth enough.

It has also been proposed to use so-called cross-linking dicarboxylic acids, for example phthalic acid, either in the pickling step or in chrome tanning. In cases where dicarboxylic acids of this kind are used in pickling, the rate at which the chrome tanning agents penetrate into the skin is reduced, in addition to which tanning difficulties are created, especially in the case of unsplit dehaired hides, and the chrome is unevenly distributed throughout the cross-section of the skin. In chrome tanning itself, these acids will have been used in solution in the form of their sodium salts with the chrome tanning agents. It is only possible to use quantities of up to about 1.5 mode per mole of $Cr_2O_3$ because, when used on a commercial scale, the solutions are only briefly stable in the pH and concentration ranges required for chrome tanning and lead to precipitation (cf., for example, Das Leder, 23. Jahrgang 1972, S. 174; Austrian Patent Specification No. 275,011; German Patent Specification No. 643,088; Journ. of the Internat. Soc. of Leather Trades Chemists, Vol 27 (1943), page 83).

It has now been found that the utilization of chrome liquors can be significantly improved by completing the tanning of dehaired hides pretanned with chromium(III) salts using mixtures consisting of chromium(III)salts, acid-binding agents and at least 1.6 moles, preferably from 2 to 3 moles, of aliphatic dicarboxylic acids with 4 to 6 carbon atoms or aromatic dicarboxylic and/or tricarboxylic acids with 8 to 13 carbon atoms and/or their salts per mole of $Cr_2O_3$ in the chromium (III)salts used for full tanning, the components advantageously being added in power form, preferably together; the total quantity of chromium dioxide offered amounts to between 1.2 and 2% and more especially to between 1.5 and 1.8%, based on the weight of the dehaired hides, and tanning is carried out with a quantity of liquor of $\leqq$ 100%, based on the weight of the dehaired hides, up to a final pH-value of the tanning liquor of $\geqq$ 3.6, more especially from 3.8 to 4.2.

Chromium(III)salts suitable for pretanning are the chromium(III)salts normally used for chrome tanning, especially chromium(III)sulfates, basic chromium(III)sulfates, and also chromium(III)salts masked with organic acids, for example formic acid or acetic acid, self-neutralizing chrome tanning agents, chrome tanning agents which, in addition to chromium(III)salts, also contain inorganic salt such as sodium sulfate, or reaction products of hexavalent chromium compounds with reducing agents.

The mixtures used to complete tanning preferably contain chromium sulfates and basic chromium sulfates as chromium(III)salts. It is also possible to use masked chromium(III)salts, more especially chromium(III)sulfates, which are preferably masked to a limited extent only.

Suitable acid-binding agents are, for example, dolomite, alkali metal carbonates and bicarbonates, alkaline-earth metal carbonates and bicarbonates, magnesium oxide or sodium sulfite.

The dolomite used is the mineral double salt $CaCO_3.MgCO_3$ which contains from 20 to 40%, preferably from 25 to 35%, of CaO and from 10 to 25%, preferably from 16 to 24%, of MgO. The dolomite may be used either on its own or in combination with other acid-binding agents, in which case the dolomite content of the mixtures should preferably amount to at least 10% of the total quantity of acid-binding agents used.

Mixtures containing acid-binding agent in amount equivalent to from 10 to 130 parts by weight of dolomite per 100 parts by weight of $Cr_2O_3$ are particularly suitable. The quantity of dolomite used is governed by the basicity of the chromium (III)-salts used, by the basicity to which these chromium (III)-compounds are to be taken during tanning, by the basicity and by the quantity of the chromium (III)-salts used for pretanning and by the quantity of the other acid-binding agents present in the mixture, if any.

Aliphatic dicarboxylic acids with 4 to 6 carbon atoms are, for example, succinic acid, glutaric acid, adipic acid, maleic acid, fumaric acid, aspartic acid, glutamic acid or mixtures thereof. It is preferred to use glutaric acid and adipic acid or mixtures thereof, optionally with other different dicarboxylic acids.

Aliphatic dicarboxylic acids with 4 to 6 carbon atoms which contain a hydroxy group in the $\alpha$-position to the carboxyl group and/or to the sulfonic acid group, should only be used in a quantity of up to about one third of the total quantity of dicarboxylic acids used.

Aromatic dicarboxylic acids and tricarboxylic acids with 8 to 13 carbon atoms are those of the benzene and naphthalene series which, in addition to the carboxyl groups, may also contain hydroxy, amino, nitro and/or halogen radicals. Phthalic acid and isophthalic acid are preferably used. Aromatic dicarboxylic and tricarboxylic acids which, in addition to the carboxyl groups, also contain sulfonic acid groups may only be used in a quantity of up to about one third of the total quantity of carboxylic acids used.

The carboxylic acids may be used in the form of the free acids, in the form of mixtures of the free acids and the salts thereof, and also individually in the form of their salts, preferably their alkali metal salts. It is preferred to use powder-form mixtures of the free carboxylic acids and their salts in a molar ratio of from 60 : 40 to 40 : 60.

Delimed and pickled dehaired hides are used in known manner for carrying out the claimed process. The chromium(III) salts used for pretanning are preferably employed in a quantity of at least 0.5% of $Cr_2O_3$ and preferably in a quantity of at least 0.8% of $Cr_2O_3$, based on the weight of the dehaired hides. In one preferred embodiment, pretanning is carried out in such a way that the skins are actually tanned throughout their entire cross-section.

The pretanned dehaired hides are preferably tanned to completion in the same bath by adding the mixtures in powder form. The components of the claimed mixtures may advantageously be added together. However, it is also possible to add only a few of these components together. Alternatively, the components may even be added individually. The basic chromium(III)salts are best added first, either on their own or together with other components. These chromium(III)salts may also be added together with the chromium(III)salts used for pretanning.

The quantities in which the mixtures are used are such that the total quantity of $Cr_2O_3$ available both for pretanning and for full tanning amounts to between 1.2 and 2%, and more especially to between 1.5 and 1.8%, of $Cr_2O_3$, based on the weight of the dehaired hides.

Full tanning is carried out in a liquor of $\leqq$ 100%, preferably from 10 to 50%, based on the weight of the dehaired hides. Tanning is carried out in such a way that, on completion of tanning, the liquor has a pH-value of $\leqq$ 3.6, more especially from 3.8 to 4.2.

The value of the process according to the invention lies in the sum of the co-ordinated individual stages which result in a particularly high degree of utilization of chrome tanning agent without any adverse effect upon the final quality of the leather where the tanning process is carried out on a commercial scale. Residual liquors with a $Cr_2O_3$-content of less than 1 g per liter are obtained.

It was not foreseeable that it would be possible, using $\geqq$ 1.6 moles of aliphatic carboxylic acids or aromatic dicarboxylic and tricarboxylic acids per mole of $Cr_2O_3$ in the chromium(III)salts used for full tanning, in conjunction with the other measures according to the invention, to carry out tanning on a commercial scale in preferably short liquors, i.e., with relatively high concentrations, without any precipitation of chromium and without any penetrating difficulties during tanning, and in spite of this to obtain high chrome utilization levels. In comparison with the use of less than 1.5 moles of aromatic dicarboxylic and tricarboxylic acids or aliphatic carboxylic acids per mole of $Cr_2O_3$, it is possible by applying the measures according to the invention to obtain a distinctly better utilization of the residual liquor.

The process according to the invention is illustrated by the following Examples wherein all parts are by weight unless otherwise expressed:

EXAMPLE 1

To produce aniline leather, 1000 kg of limed dehaired cowhide (split to a thickness of 3 mm) are first of all washed for 10 minutes with 150%, based on the weight of the skins, of water at 38° C in a tanning drum (diameter 2 meters, width 2.25 meters, speed of rotation 12 rpm). The liquor is drained off, after which the skins are delimed for 35 minutes with 70% of water at 32° C containing 3% of ammonium chloride and 0.6% of sodium bisulfite and bated for 30 minutes with 0.7% of a standard commercial-grade enzymic bating agent (e.g. Oropon OR, Rohm AG, Darmstadt) (pH-value of the solution 8.0). The cross-section of the skins no longer turns phenolphthalein red in color. The skins are then rinsed with water at 18° C for 10 minutes, and the water is drained off to leave 30% of residual liquor. 5 minutes after the addition of 4% sodium chloride, the skins are pickled with 0.6% of formic acid (95%) (dilution ratio 1 : 4) and 0.25% of sulfuric acid (96%) (dilution ratio 1 : 8) for a period of 60 minutes at pH 3.6. 3.1% of a powder-form 35% basic chromium(III)sulfate containing 26% of chromium oxide are introduced into the pickling solution. After 1 hour, 5.6% of the tanning mixture described below are added, followed by milling for 7.5 hours. The tanning mixture consists of 481 parts by weight of powder-form 33% basic chromium sulfate containing 26% of chromium oxide, 107 parts by weight of dolomite, 163 parts by weight of phthalic acid and 249 parts by weight of sodium phthalate. The final temperature is 44° C, the final pH-value is 3.7 and the residual liquor contains 0.7 g of $Cr_2O_3$ per liter. After finishing in the usual way, leathers with a full, mild feel and a very uniform color are obtained.

In the following Examples, parts stand for parts by weight.

EXAMPLE 2

100 parts of dehaired cowhide are penetrated and pickled in the same way as in Example 1 with sodium chloride, sulfuric acid and formic acid in a tanning drum in the presence of 20 parts of water (pH 3.9). 2 parts of a powder-form 50% basic chromium (II)-sulfate containing 30% of chromium oxide and 16% of formic acid are introduced into the pickling solution. After 1 hour, 5.9 parts of the tanning mixture described below are added and milling is continued for 8 hours. The tanning mixture consists of 524 parts of powder-form 33% basic chromium sulfate containing 26% of chromium oxide, 61 parts of dolomite, 27 parts of magnesium oxide, 67 parts of phthalic acid anhydride and 321 parts of the sodium salt of isophthalic acid. The final temperature is 42° C, the final pH-valve is 4.2 and the residual liquor contains 0.3 g of $Cr_2O_3$ per liter.

EXAMPLE 3

100 parts of dehaired cowhide are pretreated and pickled in the same way as in Example 1 with sodium chloride, sulfuric acid and formic acid in a tanning drum in the presence of 25 parts of water (pH 4.0). 2.3 parts of a powder-form 33% basic chromium (III)-sulfate containing 26% of chromium oxide are introduced into the pickling solution. After 1 hour, 7.0 parts of the tanning mixture described below are introduced and milling is continued for 7 hours. The tanning mixture consists of 552 parts of powder-form 33% basic chromium sulfate containing 26% of chromium oxide, 86 parts of dolomite, 44 parts of sodium carbonate, 140 parts of 3-nitrophthalic acid and 178 parts of the sodium salt of isopthalic acid. The final temperature is 40° C, the final pH-value is 4.0 and the residual liquor contains 0.7 g of $Cr_2O_3$ per liter.

EXAMPLE 4

100 parts of dehaired cowhide are pretreated and pickled in the same way as in Example 1 with sodium chloride, sulfuric acid and formic acid in a tanning drum in the presence of 30 parts of water (pH 3.8). 2.1 parts of a powder-form 33% basic chromium (III)-sulfate containing 26% of chromium oxide and 5% of acetic acid are introduced into the pickling solution. After 1 hour, 8 parts of the tanning mixture described below are added and milling is continued for 8 hours. The tanning mixture consists of 602 parts of powder-form 33% basic chromium sulfate containing 26% of chromium oxide, 74 parts of dolomite and 324 parts of the sodium salt of isophthalic acid. The final temperature is 43° C, the final pH-value is 3.9 and the residual liquor contains 0.2 g of $Cr_2O_3$ per liter.

EXAMPLE 5

100 parts of dehaired cowhide are pretreated and pickled in the same way as in Example 1 with sodium chloride, sulfuric acid and formic acid in a tanning drum in the presence of 20 parts of water (pH-value 4.0). 4.4 parts of a powder-form 33% basic chromium (III)-sulfate containing 26% of chromium oxide are introduced into the pickling solution. After 1 hour, 6.4 parts of the tanning mixture described below are added and milling is continued for 7.5 hours. The tanning mixture consists of 420 parts of powder-form 33% basic chromium sulfate containing 26% of chromium oxide, 88 parts of dolomite and 492 parts of the sodium salt of 4-chloroisophthalic acid. The final temperature is 45° C, the final pH-value is 4.2 and the residual liquor contains 0.4 g of $Cr_2O_3$ per liter.

EXAMPLE 6

100 parts of dehaired cowhide are pretreated and pickled in the same way as in Example 1 with sodium chloride, sulfuric acid and formic acid in the usual way in a tanning drum in the presence of 20 parts of water (pH 5.0). 3.4 parts of potassium chrome drum alum containing 15 % of chromium oxide are introduced into the pickling solution. After 1 hour, 5.5 parts of the tanning mixture described below are added and milling is continued for 7.5 hours. The tanning mixture consists of 559 parts of powder-form 33% basic chromium sulfate containing 26% of chromium oxide, 50 parts of dolomite, 29 parts of magnesium oxide and 362 parts of the sodium salt of terephthalic acid. The final temperature is 40° C, the final pH-value is 4.3 and the residual liquor contains 0.1 g of $Cr_2O_3$ per liter.

EXAMPLE 7

100 parts of dehaired cowhide are pretreated and pickled in the same way as in Example 1 with sodium chloride, sulfuric acid and formic acid in a tanning drum in the presence of 30 parts of water (pH 3.8). 4 parts of a powder-form 50% basic chromium (III)-sulfate containing 30% of chromium oxide and 16% of formic acid are introduced into the pickling solution. After 1 hour, 8.3 parts of the tanning mixture described below are added and milling is continued for 8 hours. The tanning mixture consists of 372 parts of powder-form 33% basic chromium sulfate containing 26% of chromium oxide, 48 parts of dolomite, 34 parts of sodium bicarbonate, 107 parts of 3-nitrophthalic acid and 439 parts of the sodium salt of benzene-1,3,5-tricarboxylic acid. The final temperature is 42° C, the final pH-value is 4.0 and the residual liquor contains 0.4 g of $Cr_2O_3$ per liter.

EXAMPLE 8

100 parts of dehaired cowhide are pretreated and pickled in the same way as in Example 1 with sodium chloride, sulfuric acid and formic acid in a tanning drum in the presence of 25 parts of water (pH 3.9). 5 parts of powder-form 33% basic chromium (III)-sulfate containing 26% of chromium oxide are introduced into the pickling solution. After 1 hour, 5.1 parts of the tanning mixture described below are added and milling is continued for 7 hours. The tanning mixture consists of 377 parts of powder-form 33% basic chromium sulfate containing 26% of chromium oxide, 30 parts of dolomite, 30 parts of sodium carbonate and 554 parts of the sodium salt of 5-aminoisophthalic acid. The final temperature is 45° C, the final pH-value is 3.9 and the residual liquor contains 0.1 g of $Cr_2O_3$ per liter.

EXAMPLE 9

100 parts of dehaired cowhide are pretreated and pickled in the same way as in Example 1 with sodium chloride, sulfuric acid and formic acid in a tanning drum in the presence of 20 parts of water (pH 3.8). 6.2 parts of a powder-form 33% basic chromium (III)-sulfate containing 26% of chromium oxide and 5% of acetic acid are introduced into the pickling solution. After 1 hour, 7.3 parts of the tanning mixture described below are added and milling is continued for 7.5 hours. The tanning mixture consists of 210 parts of powder-form 33% basic chromium sulfate containing 26% of chromium oxide, 25 parts of dolomite, 150 parts of 3-nitrophthalic acid and 615 parts of the sodium salt of 5-aminoisophthalic acid. The final temperature is 42° C, the final pH-value is 3.9 and the residual liquor contains 0.7 g of $Cr_2O_3$ per liter.

EXAMPLE 10

Approximately 8 × 30 cm pieces of corresponding, dehaired cowhide, pretreated in the same way as in Example 1 up to and including deliming, are pickled and chrome-tanned for comparison in a milling machine of the kind described by E. Komarek and G. Mauthe in "Das Leder" 12 (1961), pages 285 to 289, especially page 287.

100 parts of one piece A of dehaired cowhide are pickled with 3 parts of sodium chloride, 0.7 parts of formic acid and 0.4 parts of sulfuric acid in the usual way in a milling machine in the presence of 11 parts of water (pH 3.7). 3.1 parts of a powder-form 33% basic chromium(III)sulfate containing 26% of chromium oxide are introduced into the pickling solution. After 1 hour, 5.6 parts of the tanning mixture described below are added. The tanning mixture consists of 481 parts of powder-form 33% basic chromium sulfate containing 26% of chromium oxide, 163 parts of phthalic acid, 249 parts of sodium phthalate and 107 parts of dolomite.

100 parts of the corresponding piece B of dehaired cowhide are pickled with 3 parts of sodium chloride, 2.3 parts of phthalic acid (equivalent quantity of the phthalic acid and sodium phthalate used in the full tanning of comparison piece A) in the usual way in a milling machine in the presence of 11 parts of water (pH 4.0). 3.1 parts of a powder-form 33% basic chromium-(III)sulfate containing 26% of chromium oxide are introduced into the pickling solution. After 1 hour, 3.3 parts of the tanning mixture described below are added. The tanning mixture consists of 820 parts of powder-form 33% basic chromium sulfate, containing 26% chromium oxide, and 180 parts of dolomite.

In order to test the tanning rate, tanning in the milling machine is interrupted and the comparable pieces A and B of the leather are cut. The piece A pickled without phthalic acid is found to have tanned throughout more quickly by comparison with the piece B pickled with phthalic acid for the same pH-values of the residual liquors.

EXAMPLE 11

100 parts of dehaired cowhide are pretreated and pickled in the same way as in Example 1 with sodium chloride, sulfuric acid and formic acid in a tanning drum in the presence of 20 parts of water (pH-value 3.6). 3.1 parts of a powder-form 33% basic chromium (III)-sulfate containing 26% of chromium oxide are introduced into the pickling solution. After 1 hour, 8.3 parts of the tanning mixture described below are added and milling is continued for 8 hours. The tanning mixture consists of 419 parts of powder-form 33% basic chromium sulfate, containing 26% of chromium oxide, 65 parts of dolomite, 107 parts of phthalic acid and 409 parts of the sodium salt of 1,8-naphthalene dicarboxylic acid. The final temperature is 43° C, the final pH-value is 4.1 and the residual liquor contains 0.8 g of $Cr_2O_3$ per liter.

EXAMPLE 12

100 parts of dehaired cowhide are pretreated and pickled in the same way as in Example 1 with sodium chloride, sulfuric acid and formic acid in a tanning drum in the presence of 20 parts of water (pH 3.9). 6 parts of a powder-form 33% basic chromium (III)-sulfate containing 26% of $Cr_2O_3$ are introduced into the pickling solution. After 1 hour, 0.7 parts of sodium carbonate (dissolved 1 : 10 in water) are added continuously over a period of 1 hour. After another 3 hours, a mixture of 1.3 parts of phthalic acid and 1.8 parts of sodium phthalate is added and milling is continued for 4 hours. The final temperature is 45° C, the final pH-value is 3.7 and the residual liquor contains 0.6 g of $Cr_2O_3$ per liter.

EXAMPLE 13

To produce aniline leather, 1000 kg of limed, dehairded cowhide (split to a thickness of 3 mm) are first washed for 10 minutes with 150%, based on the weight of the hides, of water at 38° C in a tanning drum (diameter 2 meters, width 2.25 meters, rotational speed 12 rpm). The solution is drained off and the hides are sebsequently delimed with 70% of water at 32° C containing 3% of ammonium chloride and 0.6% of sodium bisulfite, followed by bating for 30 minutes with 0.7% of a standard commercial-grade beating agent (pH-value of the solution 8.0). The cross-section of the hides no longer turns henolphthalein red in color. Thereafter the hides are rinsed with water at 18° C for 10 minutes and the rinsing water is drained off in such a quantity as to leave a residual solution in the amount of 30% by weight of the pelts. 5 minutes after the addition of 4% sodium chloride, the hides are pickled for 60 minutes with 0.6% of formic acid (95%) (diluted 1 : 4) and 0.25% of sulfuric acid (96%) (diluted 1 : 8) (pH 3.6). 2.6% of a powder-form 33% basic chromium-(III)-sulfate containing 26% of chromium oxide are introduced into the pickling solution. After 1 hour, 5.8% of the tanning mixture described below are added and milling is continued for 7.5 hours.

The tanning mixture consists of 520 parts by weight of powder-form 33% basic chromium sulfate containing 26% of chromium oxide, 115 parts by weight of dolomite, 140 parts by weight of glutaric acid and 225 parts by weight of sodium glutarate. The final temperature is 45° C, the final pH-value is 4.0 and the residual liquor contains 0.5 g of $Cr_2O_3$ per liter. After finishing in the usual way, leathers with a full, mild feel and an extremely uniform color are obtained.

EXAMPLE 14

100 parts by weight of dehaired cowhide pretreated in the same way as in Example 13 are pickled with sodium chloride, sulfuric acid and/or formic acid in the usual way in a tanning drum in the presence of 20 parts of water (pH 3.7). 2.6 parts of a powder-form 50% basic chromium(III) sulfate containing 30% of chromium oxide and 16% of formic acid are introduced into the pickling solution. After 1 hour, 6.9 parts of the tanning mixture described below are added and milling is continued for 8 hours. The tanning mixture consists of 512 parts of powder-form 33% basic chromium sulfate containing 26% of chromium oxide, 113 parts of dolomite, 153 parts of adipic acid and 222 parts of sodium glutarate. The final temperature is 40° C, the final pH-value is 4.2 and the residual liquor contains 0.4 g of $Cr_2O_3$ per liter.

EXAMPLE 15

100 parts of dehaired cowhide pretreated in the same way as in Example 13 are pickled with sodium chloride, sulfuric acid drum in the presence of 30 parts of water (pH 3.9). 5 parts of a powder-form 33% basic chromium(III)-sulfate containing 26% of chromium oxide are introduced into the pickling solution. After 1 hour, 3.45 parts of the tanning mixture described below are added and milling is continued for 7 hours. The tanning mixture consists of 290 parts of powder-form 33% basic chromium sulfate, containing 26% of chromium oxide, 15 parts of dolomite and 695 parts of sodium glutarate. The final temperature is 42° C, the final pH-value is 3.9 and the residual liquor contains 0.2 g of $Cr_2O_3$ per liter.

EXAMPLE 16

100 parts of dehaired cowhide pretreated in the same way as in Example 13 are pickled with sodium chloride, sulfuric acid and formic acid in the usual way in a tanning drum in the presence of 20 parts of water (pH 3.9). 2.9 parts of a powder-form 33% basic chromium(III)-sulfate containing 26% of chromium oxide are introduced into the pickling solution. After 1 hour, 7.0 parts of the tanning mixture described below are added and milling is continued for 7 hours. The tanning mixture consists of 548 parts of powder-form 33% basic chromium sulfate containing 26% of chromium oxide, 230 parts of dolomite and 222 parts of glutaric acid. The final temperature is 42° C, the final pH-value is 4.3 and the residual liquor contains 0.7 g of $Cr_2O_3$ per liter.

EXAMPLE 17

100 parts of dehaired cowhide pretreated in the same way as in Example 13 are pickled with sodium chloride, sulfuric acid and formic acid in the usual way in a tanning drum in the presence of 25 parts of water (pH 4.0). 2.0 parts of a powder-form 33% basic chromium(III)-sulfate containing 26% of chromium oxide are introduced into the pickling solution. After 1 hour, 6.3 parts of the tanning mixture described below are added and milling is continued for 7.5 hours. The tanning mixture consists of 476 parts of powder-form 33% basic chromium sulfate containing 26% of chromium oxide, 74 parts of dolomite, 31 parts of sodium bicarbonate, 156 parts of glutamic acid and 263 parts of sodium adipate. Th final temperature is 45° C, the final pH-value is 4.2 and the residual liquor contains 0.5 g of $Cr_2O_3$ per liter.

EXAMPLE 18

100 parts of dehaired cowhide pretreated in the same way as in Example 13 are pickled for 15 minutes with sodium chloride, sulfuric acid and formic acid in the usual way in a tanning drum in the presence of 20 parts of water (pH 4.1). 4.0 parts of potassium chrome alum containing 15% of chromium oxide are introduced into the pickling solution. After 1.75 hours, 6.2 parts of the tanning mixture described below are added and milling is continued for 8 hours. The tanning mixture consists of 485 parts of powder-form 33% basic chromium sulfate containing 26% of chromium oxide, 89 parts of dolomite, 38 parts of magnesium oxide, 175 parts of glutaric acid and 213 parts of the sodium salt of furmaric acid. The final temperature is 43° C, the final pH-value is 4.2 and the residual liquor contains 0.3 g of $Cr_2O_3$ per liter.

EXAMPLE 19

100 parts of dehaired cowhide pretreated in the same way as in Example 13 are pickled with sodium chloride, sulfuric acid and formic acid in the usual way in a tanning drum in the presence of 20 parts of water (pH 3.9). 3.5 parts of a powder-form 33% basic chromium(III)-sulfate containing 26% of chromium oxide are introduced into the pickling solution. After 1 hour, 9.1 parts of the tanning mixture described below are added and milling is continued for 8 hours. The tanning mixture consists of 424 parts of powder-form 33% basic chromium sulfate containing 26% of chromium oxide, 55 parts of dolomite, 22 parts of sodium carbonate, 126 parts of aspartic acid and 373 parts of sodium adipate. The final temperature is 42° C, the final pH-value is 4.2 and the residual liquor contains 0.6 g of $Cr_2O_3$ per liter.

EXAMPLE 20

Approximately 8 × 30 cm pieces of corresponding, dehaired cowhide, pretreated in the same way as in Example 1 up to and including deliming, are pickled and chrome-tanned for comparison in a milling machine of the kind described by E. Komarek and G. Mauthe in "Das Leder" 12 (1961), pages 285 to 289, especially page 287.

100 parts of one piece A of unhaired cowhide are pickled with 3 parts of sodium chloride, 0.7 part of formic acid and 0.4 part of sulfuric acid in the usual way in a milling machine in the presence of 11 parts of water (pH 3.7). 3 parts of a powder-form 33% basic chromium(III)-sulfate containing 26% of chromium oxide are introduced into the pickling solution. After 1 hour, 5.8 parts of the tanning mixture described below are added. The tanning mixture consists of 520 parts of powder-form 33% basic chromium sulfate containing 26% of chromium oxide, 140 parts of glutaric acid, 225 parts of sodium glutarate and 115 parts of dolomite.

100 parts of the corresponding piece B of dehaired cowhide are pickled with 3 parts of sodium chloride, 1.8 parts of glutaric acid (equivalent quantity, based on the glutaric acid and sodium glutarate used in the full tanning of comparison piece A) and 0.2 part of sulfuric acid in the usual way in a milling machine in the presence of 11 parts of water (pH 4.0). 3 parts of a powder-form 33% basic chromium(III)-sulfate containing 26% of chromium oxide are introduced into the pickling solution. After 1 hour, 3.8 parts of the tanning mixture described below are added. The tanning mixture consists of 820 parts of powder-form 33% basic chromium sulfate, containing 26% of chromium oxide, and 180 parts of dolomite.

In order to test the tanning rate, tanning in the milling machine is interrupted and the comparable pieces A and B of leather are cut. The piece A pickled without glutaric acid is found to have tanned throughout more quickly by comparison with the piece B pickled with glutaric acid for the same pH-values of the residual liquors.

EXAMPLE 21

100 parts of dehaired cowhide pretreated in the same way as in Example 13 are pickled with sodium chloride, sulfuric acid and formic acid in the usual way in a tanning drum in the presence of 20 parts of water (pH-value 3.9). 6 parts of a powder-form 33% basic chromium (III)-sulfate containing 26% $Cr_2O_3$ are introduced into the pickling solution. After 1 hour, 0.6 parts of sodium carbonate (dissolved 1 : 10 in water) are added continuously over a period of 1 hour. After another 3 hours, a mixture of 1 part of glutaric acid and 1.6 parts of sodium glutarate is added and milling is continued for 4 hours. The final temperature is 45° C, the final pH-value is 3.8 and the residual liquor contains 0.3 g of $Cr_2O_3$ per liter.

It will be appreciated that the instant specification and examples are set forth by way of illustration and not limitation, and that various modifications and changes may be made without departing from the spirit and scope of the present invention.

What is claimed is:

1. In the chrome-tanning of hides to produce leather wherein a hide is pickled, pretanned with a chromium (III) salt, and full tanned with a tanning mixture containing a chromium (III) salt, an acid-binding agent and a polycarboxylic acid or salt thereof, the improvement which comprises employing as said polycarboxylic acid or salt thereof at least 1.6 moles per mole of $Cr_2O_3$ in the chromium (III) salt employed for full tanning of an aliphatic dicarboxylic acid of 4 to 6 carbon atoms or an aromatic dicarboxylic or tricarboxylic acid containing 8 to 13 carbon atoms or an alkali metal salt thereof, the total quantity of $Cr_2O_3$ employed in pretanning and full tanning ranging from 1.2 to 2% by weight of the hide, full tanning being carried out with up to 100% of the tanning liquor based on the weight of the hide to a final pH of the liquor of at least 3.6.

2. The process according to claim 1, wherein the acid-binding agent comprises dolomite.

3. The process according to claim 1, wherein the chromium (III) salt used for full tanning is present during pretanning.

4. The process according to claim 1, wherein after pretanning there are added to the tanning liquor in powder form additional chromium (III) salt, the acid-binding agent and the polycarboxylic acid or alkali metal salt thereof.

5. The process according to claim 4, wherein the polycarboxylic acid or alkali metal salt thereof is employed in about 2 to 3 times the molar amount of $Cr_2O_3$ in the chromium (III) salt employed for full tanning, the total quantity of $Cr_2O_3$ employed in pretanning and full tanning ranges from 1.5 to 1.8% by weight of the hide, and the final pH of the tanning liquor ranges from 3.8 to 4.2.

6. A tanning composition comprising (a) a chromium (III) salt, (b) an aliphatic dicarboxylic acid of 4 to 6 carbon atoms or an aromatic dicarboxylic or tricarboxylic acid containing 8 to 13 carbon atoms or an alkali metal salt thereof present in at least 1.6 times the molar amount of $Cr_2O_3$ in the chromium (III) salt, and (c) an acid-binding agent.

7. The composition of claim 6, wherein 0.1 to 1.3 parts by weight of the acid-binding agent are employed per part by weight of $Cr_2O_3$ in the chromium (III) salt.

8. The composition of claim 7, wherein the acid-binding agent is dolomite.

9. The composition of claim 8, wherein (b) is an aromatic dicarboxylic or tricarboxylic acid or alkali metal salt thereof and is present in 2 to 3 times the molar amount of the $Cr_2O_3$ in the chromium (III) salt.

10. The composition of claim 8, wherein (b) is an aliphatic dicarboxylic acid of 4 to 6 carbon atoms or alkali metal salt thereof and is present in 2 to 3 times the molar amount of the $Cr_2O_3$ in the chromium (III) salt.

11. The composition of claim 6, wherein (b) is a member selected from the group consisting of succinic acid, glutaric acid, adipic acid, phthalic acid, isophthalic acid or a mixture thereof.

* * * * *

UNITED STATES PATENT AND TRADEMARK OFFICE

CERTIFICATE OF CORRECTION

PATENT NO. : 4,042,321

DATED : August 16, 1977

INVENTOR(S) : Klaus Backer, et al.

It is certified that error appears in the above-identified patent and that said Letters Patent are hereby corrected as shown below:

| | |
|---|---|
| Col. 1, line 29 | cancel "drain-" and substitute --drawn- -- |
| Col. 1, line 44 | cancel "mode" and substitute --mole-- |
| Col. 1, line 62 | cancel "power" and substitute --powder-- |
| Col. 2, line 10 | cancel "salt" and substitute --salts-- |
| Col. 3, line 30 | cancel " $\leqq$ " and substitute -- $\geqq$ -- |
| Col. 4, line 11 | cancel "35%" and substitute --33%-- |
| Col. 4, line 28 | cancel "penetrated" and substitute --pretreated-- |
| Col. 4, line 32 | cancel "(II)" and substitute -- (III) -- |
| Col. 4, line 42 | cancel "valve" and substitute --value-- |
| Col. 5, line 24 | delete "drum" before "alum" |

UNITED STATES PATENT AND TRADEMARK OFFICE

CERTIFICATE OF CORRECTION

PATENT NO. : 4,042,321

DATED : August 16, 1977

INVENTOR(S) : Klaus Backer, et al.

It is certified that error appears in the above-identified patent and that said Letters Patent are hereby corrected as shown below:

| | |
|---|---|
| Col. 6, line 53 | cancel "of" (second occurrence) and substitute --to-- |
| Col. 6, line 63 | before "chromium" insert --of-- |
| Col. 6, line 66 | delete "the" before "leather" |
| Col. 7, line 43 | cancel "sebsequently" and substitute --subsequently-- |
| Col. 7, line 47 | cancel "beating" and substitute --bating-- |
| Col. 7, line 49 | cancel "henolphthalein" and substitute --phenolphthalein-- |
| Col. 8, line 25 | after "acid" insert --and formic acid in the usual way in a tanning-- |
| Col. 8, line 42 | cancel "2.9" and substitute --2.3-- |

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*